US012618586B2

(12) United States Patent
Röder et al.

(10) Patent No.: US 12,618,586 B2
(45) Date of Patent: May 5, 2026

(54) DEVICE FOR ADJUSTING AN AIR VOLUME FLOW

(71) Applicant: VIESSMANN CLIMATE SOLUTIONS SE, Allendorf (DE)

(72) Inventors: Tim Röder, Düsseldorf (DE); Eduard Rempel, Düren (DE); Fabian Becker, Aachen (DE); Paul Mathis, Düren (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 0 days.

(21) Appl. No.: 18/768,503

(22) Filed: Jul. 10, 2024

(65) Prior Publication Data

US 2025/0020362 A1 Jan. 16, 2025

(30) Foreign Application Priority Data

Jul. 11, 2023 (EP) ..... 23184606

(51) Int. Cl.
*F24F 13/12* (2006.01)
*F24F 11/74* (2018.01)
(Continued)

(52) U.S. Cl.
CPC ..... *F24F 13/12* (2013.01); *F24F 11/74* (2018.01); *F24F 11/89* (2018.01); *F24F 13/06* (2013.01);
(Continued)

(58) Field of Classification Search
CPC ..... F24F 13/12; F24F 13/24; F24F 13/105; F24F 13/06; F24F 11/74; F24F 11/89; F16K 3/085
See application file for complete search history.

(56) References Cited

U.S. PATENT DOCUMENTS 1,806,530 A * 5/1931 Giesler ..... G05D 23/08 137/599.08
2,021,807 A * 11/1935 Selsey ..... F16K 3/085 251/180

(Continued)

FOREIGN PATENT DOCUMENTS

KR 20-0472462 Y1 5/2014
WO 2022/101056 A1 5/2022

OTHER PUBLICATIONS

European Search Report for 23184606.4, Dec. 14, 2023.

*Primary Examiner* — William M Mccalister
(74) *Attorney, Agent, or Firm* — Sughrue Mion, PLLC

(57) ABSTRACT

A device for adjusting an air volume flow, in particular in an air distribution network, has a central air channel which can be flowed through. The device has a throttle (6) which is arranged in the central air channel and which has at least a first throttle portion (60) having first blocking elements (601) and a second throttle portion (61) having second blocking elements (611). The position of the second blocking elements (611) can be changed relative to the first blocking elements (601) in order to change a size of a cross section of the air channel which can be flowed through. The first blocking elements (601) and the second blocking elements (611) are configured in such a manner that in approximately all positions between the first end position and the second end position in approximately any radial direction they form a portion of the cross section which can be flowed through. The cross section which can be flowed through is expanded in at least some of the positions between the first and second end positions in the direction towards the longitudinal centre axis (L). The device according to the invention for adjusting a volume flow optimises the outflow behaviour.

15 Claims, 9 Drawing Sheets

(51) Int. Cl.

| | |
|---|---|
| ***F24F 11/89*** | (2018.01) |
| ***F24F 13/06*** | (2006.01) |
| ***F24F 13/10*** | (2006.01) |
| *F24F 13/24* | (2006.01) |

(52) U.S. Cl.
CPC ..... *F24F 13/105* (2013.01); *F24F 13/24* (2013.01); *F24F 2221/26* (2013.01)

(56) References Cited

U.S. PATENT DOCUMENTS 2,311,708 A * 2/1943 Sundholm ..... F16K 3/085 137/320
2,342,482 A * 2/1944 Ohlinger ..... F16K 3/085 222/427
3,059,893 A * 10/1962 Pursel ..... F16K 3/085 137/243.2
3,221,634 A * 12/1965 Boesen ..... F24F 13/105 454/212
3,433,265 A * 3/1969 Bartholet ..... F16K 3/085 210/395
3,812,770 A * 5/1974 Morozov ..... F24F 13/06 416/186 A
4,161,307 A * 7/1979 Clinch ..... F16K 3/085 251/301
4,328,831 A * 5/1982 Wolff ..... B65G 53/30 251/59
4,353,500 A * 10/1982 Brown ..... G05D 23/08 236/34.5
4,516,606 A * 5/1985 Worley ..... F15D 1/0005 137/625.3
4,554,943 A * 11/1985 Claney ..... F16K 3/085 251/208
4,674,537 A * 6/1987 Bergmann ..... F16K 3/085 251/208
5,402,821 A * 4/1995 Harstad ..... F16K 3/32 138/46
5,417,083 A * 5/1995 Eber ..... F16K 31/041 251/285
5,669,373 A * 9/1997 Gulddal ..... F23L 13/00 126/77
5,699,941 A * 12/1997 Johnson ..... G01G 11/003 222/548
6,192,922 B1 * 2/2001 MacGibbon ..... G05D 7/0635 137/630.21
6,598,851 B2 * 7/2003 Schiavone ..... F16K 31/041 251/129.11
6,726,174 B2 * 4/2004 Bareis ..... F02M 26/68 251/205
6,926,250 B1 * 8/2005 Hashimoto ..... F16K 31/043 251/129.11
6,945,264 B1 * 9/2005 Denzel ..... F16K 3/085 137/454.6
8,720,423 B2 * 5/2014 Perr ..... F16K 3/085 123/568.23
8,974,201 B2 * 3/2015 Oulman ..... F04B 39/10 417/536
9,777,866 B2 * 10/2017 Deng ..... F16K 31/0668
10,299,642 B2 * 5/2019 Buchanan ..... F04D 29/4213
10,865,896 B2 * 12/2020 Zonneveld ..... F16K 27/045
11,939,981 B2 * 3/2024 Chapman ..... F04B 1/0421
2003/0034075 A1 * 2/2003 Stevenson ..... F16K 3/085 137/625.22
2017/0348813 A1 * 12/2017 Hartness ..... B23Q 41/08
2018/0127965 A1 * 5/2018 Beach ..... E03F 1/006

* cited by examiner

DEVICE FOR ADJUSTING AN AIR VOLUME FLOW

TECHNICAL FIELD

The present invention relates to a device for adjusting an air volume flow, in particular a supply air valve and/or an exhaust air valve.

PRIOR ART

Air distribution networks are used particularly in buildings for the aeration and venting and sometimes for the air-conditioning of rooms. Controlled accommodation and office ventilation installations have by now become sophisticated systems which use centralized or decentralized ventilation apparatus.

The wall, ceiling or floor openings of a building have air passages having inserts which are connected to the air distribution network. Such air passages change the shape of the air flow and/or they regulate the air volume flow. Depending on the direction of the flow into the room or out of the room, they are referred to as supply air valves or exhaust air valves. They delimit the cross section in the air channel, wherein the size of this limitation can be selected by means of throttles.

Unfortunately, such supply and discharge air valves often cannot be adjusted in the installed state or only with a relatively large degree of complexity. Another disadvantage is that individual components of the valve depending on the degree of adjustment of the valve protrude to differing extents into the room, rise from the building wall and impair the visual appearance of the room.

Supply air valves, that is to say, valves through which the air flows into a room, additionally often have the disadvantage that they do not distribute the discharged air in a uniform manner. A seated or lying person who is directly exposed to the discharged air may find this to be unpleasant. Furthermore, strips of dirt deposits which are more visible than a uniform deposit are thereby produced. A non-homogeneous discharge behaviour additionally leads to increased noise generation.

Another disadvantage is that exhaust air valves, that is to say, valves through which air flows out of a room, often have a different shape from supply air valves. This leads to a rather disturbed appearance in the room.

WO 2022/101056 A1 discloses an air volume throttle valve with air directing members in the form of vanes of a rotor. The air directing members are formed in each case by a first and a second air direction unit which can be rotated relative to each other so that the spacing between the air directing members and consequently the cross section, which can be flowed through, of an air channel can be changed. This device enables a changing of the free flow cross section with a consistent location of the narrowest flow cross section. This facilitates the control of the valve.

SUMMARY OF THE INVENTION

An object of the invention is to provide an improved device for adjusting a volume flow.

The device according to the invention for adjusting an air volume flow, in particular in an air distribution network, has an air channel which can be flowed through. The air channel defines a longitudinal centre axis and radial directions. The device has a throttle which is arranged in the air channel, wherein the throttle has at least a first throttle portion having first blocking elements and a second throttle portion having second blocking elements. The position of the second blocking elements can be changed relative to the first blocking elements in order to change a size of a cross section which can be flowed through in the air channel. In a first end position of the second blocking elements relative to the first blocking elements, a minimum size of the cross section which can be flowed through is achieved and, in a second end position, a maximum size of the cross section which can be flowed through is achieved. According to the invention, the first blocking elements and the second blocking elements are configured in such a manner that in approximately all positions between the first end position and the second end position in approximately any radial direction they form a portion of the cross section which can be flowed through, wherein the cross section which can be flowed through is expanded in at least some of the positions between the first and second end positions in the direction towards the longitudinal centre axis.

The air channel is preferably a central air channel.

According to the invention, consequently, in approximately any adjustment of the throttle cross sections which can be flowed through in any radial direction are present. This is in contrast to known blocking elements with a vane shape in the form of a circle sector which do not enable any regions which can be flowed through inside the blocking circle sector.

This distribution, which is changed in comparison with the prior art, of the cross section regions which can be flowed through homogenizes the discharge behaviour. This distribution can be achieved, for example, by distorting the shapes of known blocking elements, in particular throttle vanes. For example, the known circle sector form can be bent until a curved form is produced. This can be seen in FIGS. 14 and 15. Other types of distortions are, however, also possible. For example, by adding lateral recesses and/or through-holes into the blocking elements.

Since the cross section which can be flowed through is expanded in the direction towards the longitudinal centre axis, small discharge angles are avoided. Since no divided flows can thereby be produced, the acoustic behaviour is improved. The noise loading is minimized. The cross section which can be flowed through generally terminates with spacing from the longitudinal centre axis.

This expansion of the cross section which can be flowed through may be present continuously or in steps from the outer circumference of the throttle to the longitudinal centre axis. Preferably, however, this relates only to an inner region. That is to say, tapered portions in the cross section which can be flowed through may also be present in a radially outward direction. Preferably, the cross section which can be flowed through is first tapered in at least some of the positions between the first and second end positions in the direction towards the longitudinal centre axis and is then expanded.

Preferably, the cross section which can be flowed through forms in at least some of the positions between the first and second end positions a plurality of L-shaped regions which are sub-divided by the first and second blocking elements. The short legs of the L-shaped regions preferably form the expanded region which can be flowed through in the vicinity of the longitudinal centre axis.

As a result of the avoidance of small angles, this L-shape enables an optimum discharge behaviour. Furthermore, it can be implemented in a simple manner.

At least the long leg of the L-shaped region is preferably configured in a bent manner. In some exemplary embodiments, the transition between the long and the short leg of the L-shaped region is configured in a rounded manner.

The positions of the blocking elements can preferably be changed when the device is mounted in a wall opening. This facilitates the adaptation of the air flow desired for living comfort.

Depending on the embodiment, the blocking elements can be moved in a motorized manner, for example, in accordance with sensor values and/or by means of remote-controlled actuation of the motor. Preferably, however, they can be manually adjusted mechanically. The individual positions are preferably retained in a fixed manner, for example, using a rastering.

The first and second blocking elements may be formed differently. Preferably, they can be rotated or at least pivoted relative to each other. Preferably, they are vanes which are configured to be curved in the radial directions.

The first blocking elements are preferably vanes which extend away from the longitudinal centre axis towards the free ends. These ends are alternatively connected to an outer circumferential ring. Preferably, the first blocking elements terminate in the region of the longitudinal centre axis in a common region, in this instance referred to as a central blocking centre portion.

The second blocking elements are preferably vanes which extend from a common outer circumferential ring in the direction towards the longitudinal centre axis, but terminate in a free manner with spacing from the longitudinal centre axis. Free ends are consequently formed in the region of the longitudinal centre axis.

The expanded portion of the cross section which can be flowed through can be obtained in different manners by means of corresponding configuration of the first and/or second blocking means. In preferred embodiments, the free ends of the second blocking elements are arranged around a central free region which is greater in cross section than a cross section of the central blocking central portion. A free annular region which is covered only partially by the first blocking elements is thereby provided. This region which is distributed in a uniform manner over an inner circumference prevents divided flows and optimizes a homogeneous discharge.

The second blocking elements are preferably configured in a planar manner. This facilitates the relative position change, for example, the rotation of the second throttle portion.

In preferred embodiments, the second blocking elements are part of a throttle disc or a throttle member which is rotatably supported at the circumference thereof. In this manner, it can be configured to be centrally open so that the expanded region can be achieved in a simple manner.

The flow behaviour can additionally be optimized, in particular pressure losses can be minimized, when the first blocking elements form bent inflow faces.

In simple embodiments, the throttle is formed by the first and second throttle portion. In other embodiments, the device has a third throttle portion with third blocking elements which are arranged in a congruent manner with the first blocking elements. The second blocking elements are in this instance arranged between the first and third blocking elements and can be moved relative thereto. This enables additional improvements of the flow behaviour.

In addition, these embodiments can be used in an optimum manner as supply and discharge air valves, that is to say, for both flow directions of an air distribution network.

If the third blocking elements form bent outflow faces, the flow behaviour is optimized and in particular pressure losses are minimized.

In preferred embodiments, the first and, if present, the third throttle portion is configured in a rotationally secure manner and the second throttle portion is configured to be able to be rotated about the longitudinal centre axis. In other embodiments, others of these components are rotationally secure or displaceable or rotatable.

The assembly in wall openings can be facilitated when the device has a housing which is configured for being received in a wall opening, in particular for clamping and/or sealing receiving. Preferably, a corresponding sealing and/or clamping ring is arranged on the circumference of the housing.

In preferred embodiments, an inner flow element is further provided. It has a cover which is arranged with spacing from the first and second throttle portion and, if provided, from the third throttle portion. The cover has a circumference which increases in the direction away from the throttle. This separation of the inner flow element and throttle enables an adjustment of the throttle without the visual appearance of the supply and discharge air valve in the building space changing. The lowest portion of the valve always reaches to the same extent into the space. The valves can thereby be adjusted differently with regard to the volume of air flowing through, wherein they nonetheless produce a uniform appearance in the room. The flow element is preferably configured in a bell-like manner. If the air channel extends between the throttle lower side and the cover of the flow element, preferably in a state bent multiple times, and if it leads approximately parallel with a lid face into the room, the flow behaviour is additionally improved. The cover is the mantle or the circumferential outer shape of the flow element.

Preferably, the inner flow element also enables in the assembled state of the device access to an adjustment mechanism of the throttle. The access can, for example, be closed with a lid which can be removed and assembled again.

Alternatively, the flow element can be removed in a simple manner in order to provide access to an adjustment mechanism of the throttle. Preferably, it can be secured to the housing or to the throttle by means of a snap-fit closure or a bayonet closure.

A preferred device for adjusting an air volume flow, in particular in an air distribution network, has an air channel which can be flowed through and a throttle which is arranged in the air channel. A size of a cross section of the air channel which can be flowed through can be changed by means of the throttle. The throttle has an adjustment means for changing the cross section which can be flowed through. The device has in addition to the throttle a flow element which is arranged in the air channel and which has a cover, the circumference of which increases in the direction away from the throttle. The adjustment means can be activated with a device which is mounted in a wall opening. The flow element is preferably a central flow element.

The adjustment means preferably enables a manual or an exclusively manual change of the throttle adjustment. The individual positions are preferably held in a fixed manner, for example, by means of a rastering.

Since the throttle can be adjusted with the valve mounted, it can be verified during the adjustment whether the desired air volume flow is obtained and whether the acoustic behaviour of the valve is acceptable for the living comfort.

The flow element is located in the assembled state of the device preferably at the side, facing a building interior, of the throttle, that is to say, with a supply air valve in the flow direction after the throttle. The flow element ensures an optimum flow distribution in the building interior.

In one embodiment, the flow element can be removed and mounted again with the device mounted in the wall opening in order to enable access to the adjustment means. Preferably, the flow element can be releasably secured to the remaining device without tools, for example, by means of a snap-fit closure or a bayonet closure.

Alternatively or additionally, the flow element has a through-opening which enables access to the adjustment means. This has the advantage that the flow element does not have to be disassembled.

In one embodiment, the through-opening is arranged centrally. This is optimal for centrally supported throttle discs or throttle members. In other embodiments, it is arranged in a decentralised manner in the cover of the flow element. This is particularly suitable for non-centrally supported throttle discs or throttle members.

The flow element is preferably configured to be open at a side facing away from the throttle. Preferably, this opening is closed by means of a lid. The lid can preferably be assembled and disassembled without tools in order to provide access to the through-opening and/or adjustment means. Preferably, the lid is held on the flow element by means of magnets. It can, for example, also be releasably arranged on the flow element by means of clamping or snap-fit elements. The lid optimises the appearance of the valve in the building interior. In addition, the hollow space which is closed by means of the lid can be used for arranging other elements, for example, for sensors or actuators.

In preferred embodiments, the throttle has at least a first throttle portion having first blocking elements and a second throttle portion having second blocking elements. The position of the second blocking elements can be changed relative to the first blocking elements in order to change the size of the cross section which can be flowed through. Preferably, the cover of the flow element in the flow direction is arranged with spacing from the first blocking elements and/or the second blocking elements.

In preferred embodiments, the second throttle portion is supported in a state guided on the circumference thereof. This enables a fine adjustment of the throttle, particularly when the adjustment means is arranged in a decentralized manner, in particular on the circumference of the second throttle portion. Preferably, the second throttle portion is configured in a rotatable manner, wherein the adjustment means is arranged in a decentralised manner.

The fine adjustment is also optimized when the second throttle portion is supported centrally, but the adjustment means is arranged in a decentralised manner, in particular on the circumference of the second throttle portion.

In preferred embodiments, the second throttle portion is not guided and has no bearings in the central region. This enables the formation of an expanded cross section of the throttle which can be flowed through and prevents acute gap openings having undesirable acoustic behaviour.

The adjustment means can be formed in different manners. Preferably, it has a tooth arrangement and a gear which is in engagement with the tooth arrangement. The gear is preferably a head of a rotary pin and the tooth arrangement is preferably arranged on the second throttle portion. Other gear mechanisms can also be used.

If a rotary pin is used, it preferably has a pin which can be contacted through the through-opening of the flow element in order by rotating the pin to rotate the gear along the tooth arrangement. Alternatively, it may protrude through the through-opening.

Preferably, the pin has a receiving opening for receiving a tool. Alternatively or additionally, the pin preferably has an outer surface for non-slip contacting by means of a tool and/or a hand, for example, a knurling.

The cover of the flow element is preferably configured to be closed in an upward direction with the exception of the through-opening. The air flow is thereby guided by the throttle along the flow member in an outward direction and cannot penetrate it.

The flow element is preferably configured in one piece. The same applies to the first and second throttle portion and, if provided, a third throttle portion. The third throttle portion is preferably part of a housing of the valve, on or in which the remaining portions of the throttle and the flow element are arranged.

The flow element preferably has a bell-like configuration having a cross section which expands in a direction away from the throttle and the cover which is curved inwards. This shape optimizes a homogenous discharge of the air volume flow.

Preferably, the flow element has at the end thereof facing away from the throttle an outflow edge which is bent towards the throttle. This also optimizes the discharge behaviour of the air volume flow.

If the cover is arranged spaced apart from the first and second throttle portion and, when provided, the third throttle portion, an air volume flow which remains consistent after the throttle can be formed and the visual appearance of the device inside the building interior does not change when the throttle setting is changed.

Preferably, the position of the flow element relative to the housing or relative to the wall surface does not change when the setting of the throttle changes. Preferably, the cross section of the outlet channel or the outlet opening of the air channel also does not change when the setting of the throttle changes.

Further embodiments of the invention are set out in the dependent claims.

BRIEF DESCRIPTION OF THE DRAWINGS

Preferred embodiments of the invention are described below with reference to the drawings, which are merely for the purpose of explanation and are not intended to be interpreted in a limiting manner. In the drawings.

Components which are the same are given the same reference numerals.

DESCRIPTION OF PREFERRED EMBODIMENTS

Figure 1:
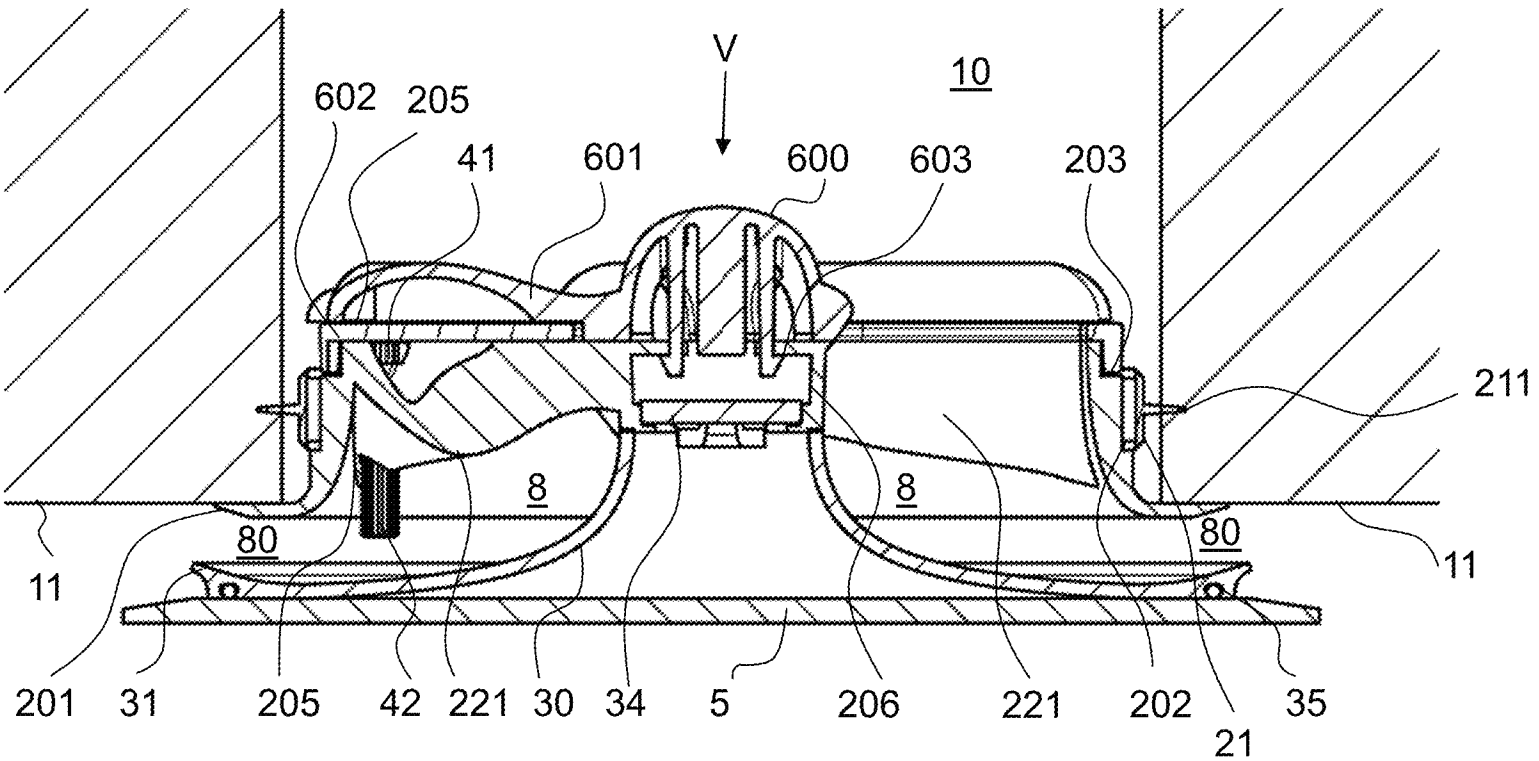
FIG. 1 shows a longitudinal section through a device according to the invention, in a state installed in a wall opening.

FIG. 1 shows a valve V according to the invention which is installed in a wall opening 10 of a wall 11. The wall opening 10 is preferably part of an air distribution network of a building. The terms "top" and "bottom" used in this text refer to the installation position of the valve in the wall opening of a building ceiling. If the wall opening is located in another wall of a building, these terms are intended to be interpreted accordingly.

The valve V is an exhaust air valve which directs air from a building space into the wall opening 10 or it is a supply air valve which directs air from the air distribution network through the wall opening into the building space.

The valve V is described below as a supply air valve, wherein it is configured identically in terms of its function as an exhaust air valve.

Figure 2:
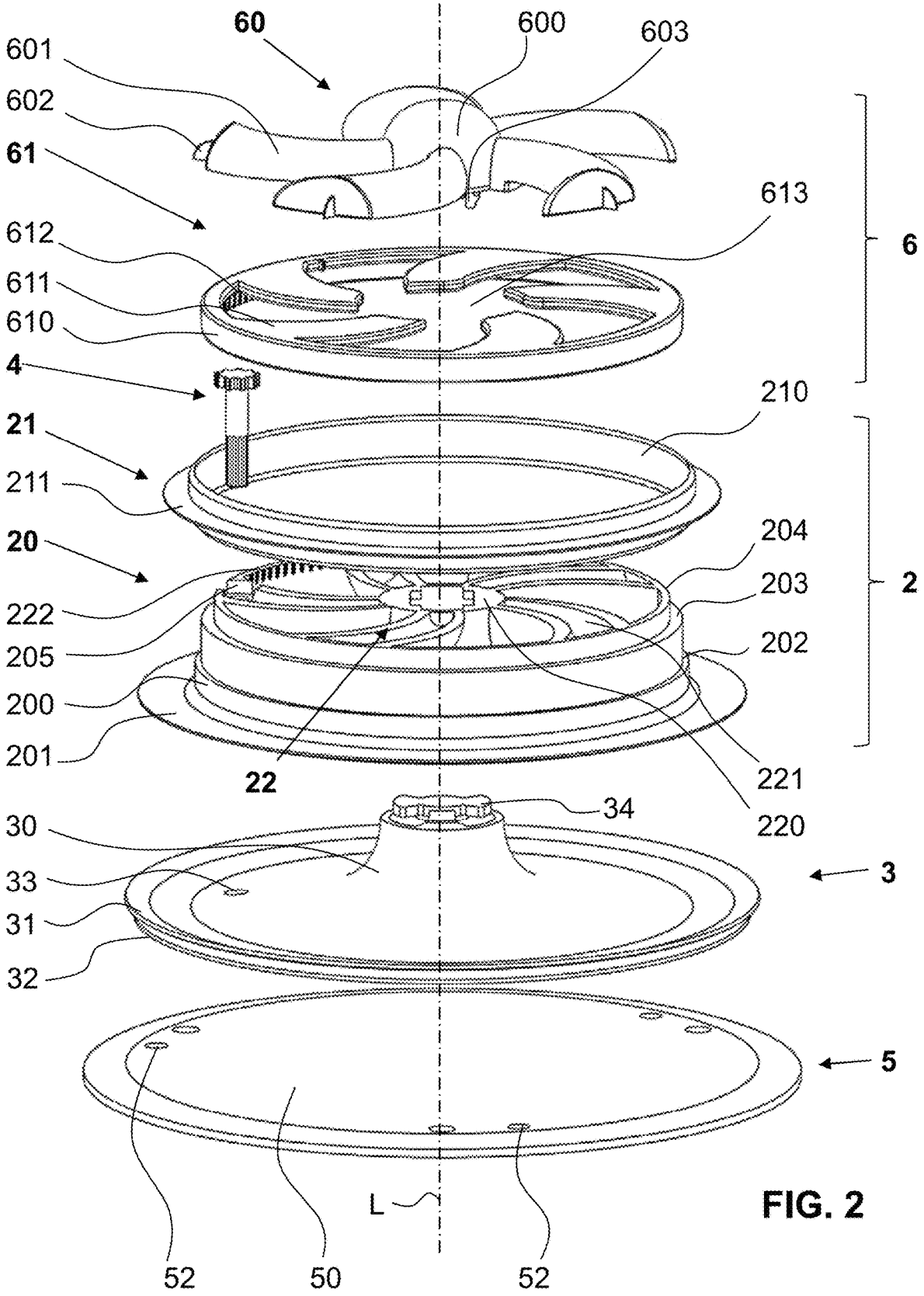
FIG. 2 shows an exploded illustration of the device according to FIG. 1 from above.
Figure 3:
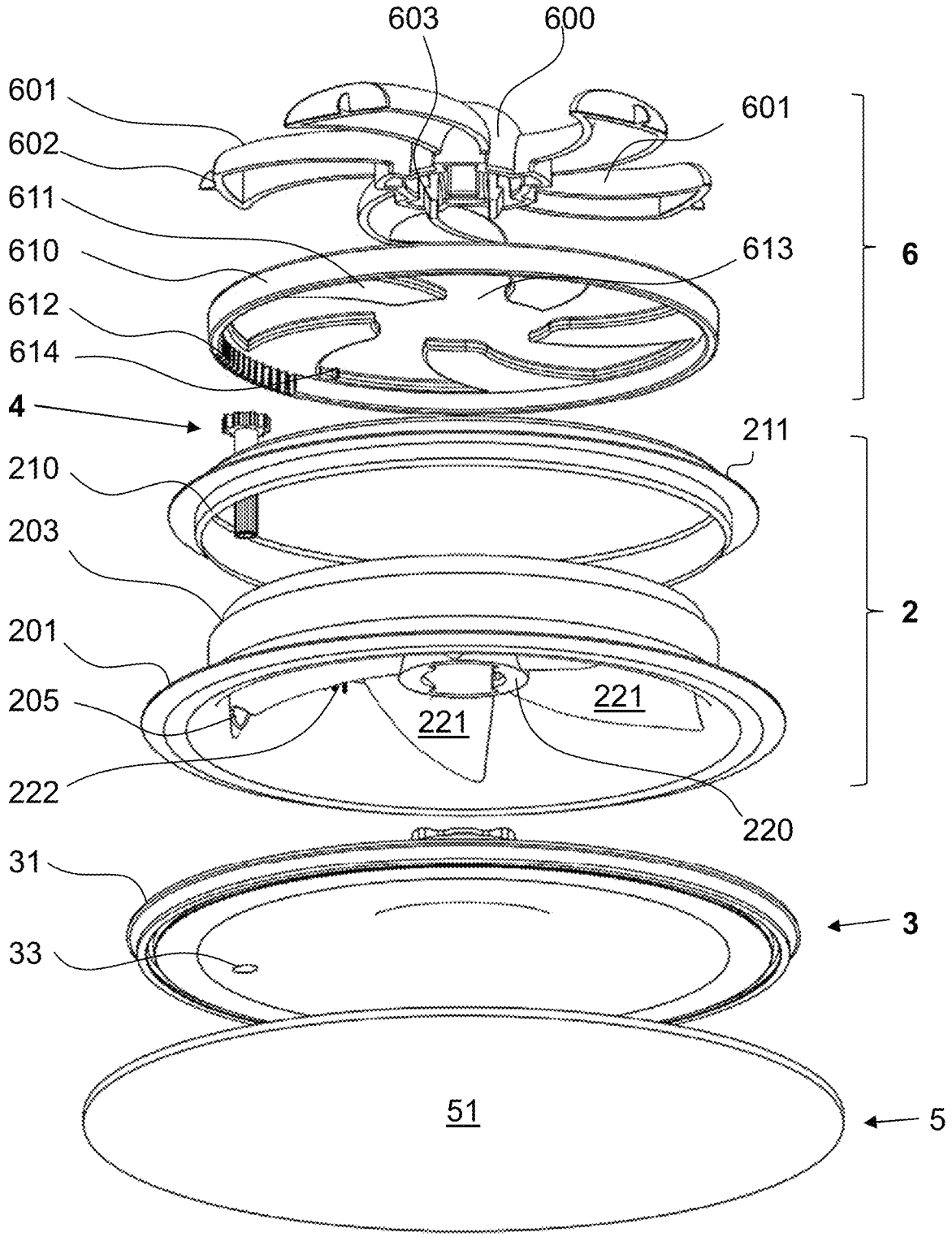
FIG. 3 shows a first exploded illustration of the device according to FIG. 1 from below.
Figure 4:
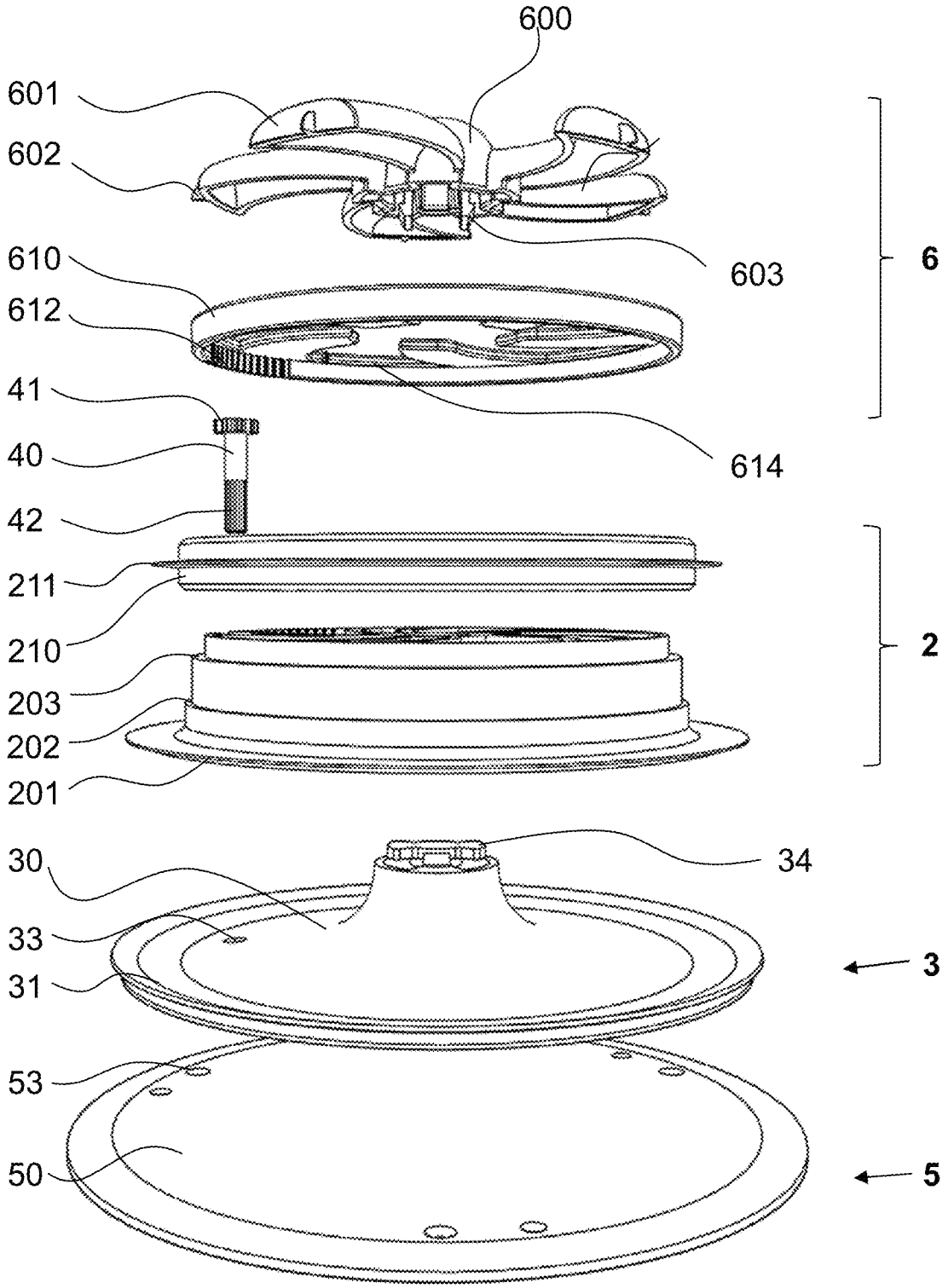
FIG. 4 shows a second exploded illustration of the device according to FIG. 1 from below.

The valve V has, as can be clearly seen in FIGS. 2 to 4, a housing 2, an inner flow element 3, a rotary pin 4, a lid 5 and a throttle 6.

The housing 2 is preferably configured in two pieces. It preferably has a round cross section. A first housing portion 20 has a hollow, circular-cylindrical base member 200 whose lowest end forms a radially outwardly protruding flange 201. With this flange 201, the valve V bears on the building wall 11, as can be seen in FIG. 1. The first flange 201 is preferably configured to be rigid and acts as a stop when the valve V is pushed into the wall opening 10, as can be seen in FIG. 1. It forms a closure for covering irregularities in the surrounding wall 11.

The base member 200 has on the outer circumference thereof a first step 202 and a second step 203. A circumferential upper end face 204 is preferably configured in a planar manner. The upper end face 204 has a recess 205 for passage of the rotary pin 4.

In the upper region of the first housing portion 20, a third throttle portion 22 which is described below in the text together with a first and a second throttle portion 60, 61 of the throttle 6 is formed.

A second housing portion 21 has a narrow, hollow-cylindrical or annular base member 210. It is surrounded by a radially protruding second flange 211. The second flange 211 is preferably in the form of a flexible sealing and/or clamping ring. It is used for sealing and releasably fixing the valve V in the wall opening 10, as can be seen in FIG. 1. The wall opening 10 preferably has for this purpose a round cross section. The second flange 211 may be injected on, formed integrally on or connected to the second base member 210 in another manner.

The second housing portion 21 surrounds the upper region of the first housing portion 20. It is positioned on the first step 202 and preferably extends up to the second step 203.

The housing 2 surrounds a central air channel which defines a longitudinal centre axis L and radial directions.

In the housing 2, there is arranged the inner flow element 3 which extends downwards to the building interior, as can be seen in FIG. 1. The inner flow element 3 is preferably configured in a hollow manner and can be closed in a downward direction with the lid 5. The flow element 3 is with the exception of a through-opening 33 for passage of the rotary pin 4 configured to be closed in an upward direction.

The flow element 3 is preferably configured in a substantially rotationally symmetrical manner. It has a bell-like configuration with a cross section which expands downwards and an inwardly curved cover 30. The flow element 3 preferably extends up to the outer edge of the first flange 201 or beyond.

The flow element 3 is retained in a fixed manner in the first housing portion 20, preferably with a bayonet closure or with another releasable and reproducible connection. These coupling elements are preferably arranged in the region of the longitudinal centre axis L. In FIG. 2, a coupling element 220 of the first housing portion 20 and a corresponding coupling element 34 of the flow element 3 can be clearly seen. It is a plug and rotary connection in the form of a bayonet closure.

As can be seen in FIG. 1, between the first housing portion 20 and the flow element 3 there is formed a flow channel which is referred to in this instance as an air channel 8. It leads from the wall opening 10 through the throttle 6 and through the annular gap between the first flange 201 and the cover 30 of the flow element 3 into the building interior. The gap is generally always of the same size, regardless of the adjustability of the throttle 6 as described below in the text. The outflow cross section of the valve V consequently remains the same even when the setting of the throttle 6 is changed, and consequently when the cross section of the throttle 6 which can be flowed through is changed.

An upwardly bent outflow edge 31 of the flow element 3 optimizes, together with the first flange 201 which is also inclined upwards, the outflow behaviour, as can be seen in FIG. 1.

The flow element 3 has a lower annular edge which forms a planar lower end face 32 which bears on the lid 5. The annular edge surrounds an inlet opening which leads into a hollow inner space. The lid 5 has a base plate 50 having a preferably planar lower end face 51. It can preferably be fitted to the flow element 3 and removed from it in a tool-free manner. To this end, magnets are arranged in both components. The magnets of the flow element 3 can be seen in FIG. 1. They are designated 35. The magnets of the lid 5 can be seen in FIGS. 2 and 4. They are designated 52.

The flow element 3 is preferably arranged in a manner fixed in position with respect to the housing 2 and is preferably non-adjustable at least in the direction of the longitudinal centre axis L, that is to say, axially.

The throttle 6 is arranged in the upper region of the valve V. It has adjustable elements for selectively narrowing the central air channel. The throttle consequently has a changeable cross section which determines the air flow which can flow through the central air channel. This changeable cross section which is determined by the throttle 6 is referred to in this text as a cross section which can be flowed through.

Following in the flow direction of the throttle 6, that is to say, facing the building interior, the cross section of the central air channel can preferably no longer be adjusted. However, it is not necessarily the same size all over. This following cross section is preferably formed by the spacing between the preferably inwardly curved inner wall of the housing 2 and the cover 30 of the flow element 3.

The throttle 6 comprises in this embodiment three components. The first throttle component 60 is connected in a rotationally secure manner to the housing 2 and/or to the third throttle portion 22. The third throttle portion 22 is configured integrally with the housing 2 and also in a rotationally secure manner with respect to the first throttle portion 60. The second throttle portion 61 is arranged between the first and the third throttle portion 60, 22 and can be pivoted or rotated about the longitudinal centre axis L.

In other embodiments, the third throttle portion 22 is also an independent component which is preferably connected to the housing 2 in a rotationally secure manner. In other embodiments, only the first and the second throttle portion 60, 61 are provided, but no third throttle portion 22 or only the second and the third throttle portions 61, 22 are provided, but no first throttle portion 60. If only two throttle portions are provided, the second throttle portion 61 is preferably also configured with an optimized configuration of the inflow or outflow face.

The first throttle portion 60 has blocking elements in the form of rotor-like first vanes 601 which extend outwards from a common central portion. This central portion forms a first coupling element 600. In this example, five first vanes 601 are provided. However, three, four, six or a different number of vanes can also be used.

Figure 5:
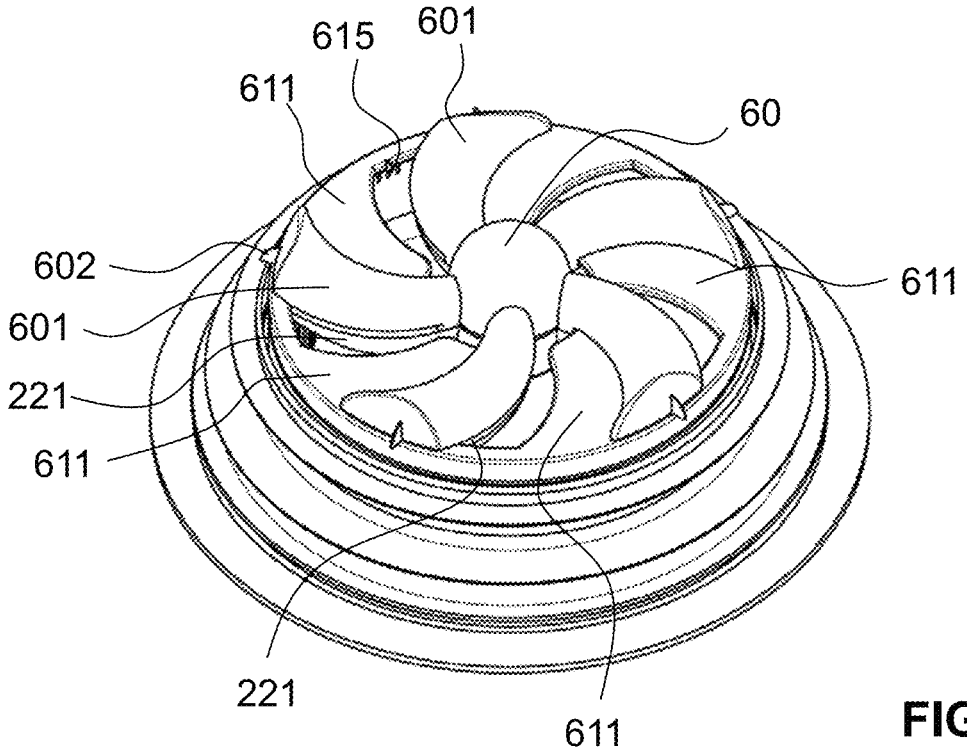
FIG. 5 shows a perspective view of the device according to FIG. 1 from above in a partially closed position of the throttle.
Figure 6:
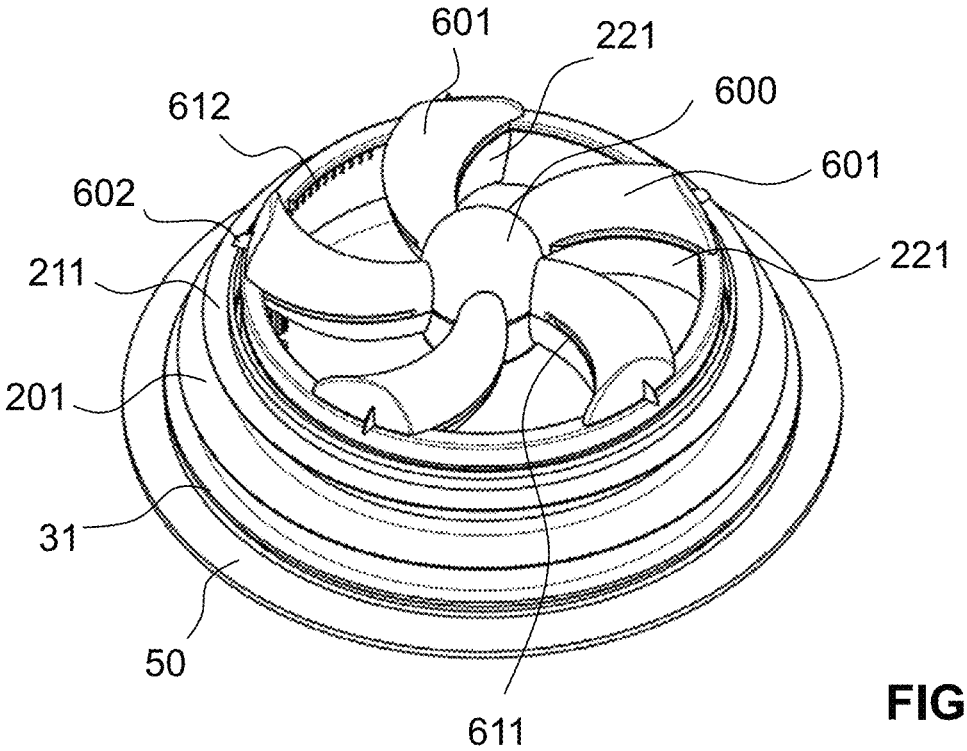
FIG. 6 shows a perspective view of the device according to FIG. 5 in a completely open position of the throttle.

At the end faces of the free ends of the first vanes 601, hooks or protrusions 602 are formed. They are used for the assembly of exhaust air filters and/or hoods. They are positioned, for example, on the upper end face of the second throttle portion 61. This can be clearly seen in FIGS. 1, 5 and 6.

The first vanes 601 expand in the direction towards the free ends thereof. Preferably, all the vanes 601 are formed in an identical manner and are the same size. The first vanes 601 are configured to be bent in a radial direction. Preferably, the face which is left free between two vanes 601 corresponds to the face of a vane 601.

The upper inflow faces of the first vanes 601 are preferably configured in a bent manner so that an aerodynamically favourable body is formed.

The third throttle portion 22 has blocking elements in the form of third vanes 221 which form geometric counterpieces with respect to the first vanes 601. They are consequently in this example also configured to be bent in a radial direction. These third vanes 221 do not terminate freely but instead their peripheral ends are formed on the inner wall of the first housing portion 20. The central ends thereof merge integrally into a central portion which is formed by the second coupling element 220.

The first coupling element 600 has hooks 603 which project downwards and which engage in receiving openings of the second coupling element 220. In this manner, the first throttle portion 60 is connected in a rotationally secure manner to the third throttle portion 22 and also to the housing 2.

When the valve V is assembled, the first and third vanes 601, 221 are in alignment with each other. The first and third vanes 601, 221 are located in a congruent manner one above the other. Preferably, the free surface of the third vanes 221 is also configured in a bent manner. This outflow face is consequently also aerodynamically optimized. Preferably, the flow faces of the first and third vanes 601, 221 are bent in an identical manner so that the valve V forms identical inflow and outflow faces and can consequently be used both for supply and exhaust air.

The intermediate second throttle portion 61 has an outer ring 610. On the upper end of the ring 610, inwardly protruding blocking elements in the form of second vanes 611 are formed. The outer ring 620 is positioned with the free lower end of the cover thereof on the second step 203 of the housing 2. It additionally rests with the inwardly protruding upper circumferential edge on the upper end face 204 of the housing 2. This can be clearly seen in FIGS. 1, 2, 3 and 4.

The ring 610 and consequently the second throttle portion 61 can be rotated about the longitudinal centre axis L, wherein it is guided by the base member 210 of the second housing portion 21 during rotation and is fixed in the axial position thereof by the projections 602 of the first throttle portion 60.

The second vanes 611 of the second coupling portion 61 terminate freely in the direction towards the longitudinal centre axis L. They are also configured in a bent manner, wherein they preferably have the same bending radii as the first and third vanes 620, 221. The same number of second vanes 611 as there are first and third vanes 601, 221 are preferably provided. The second vanes 611 can be configured in a flat manner. Other embodiments are possible.

The second throttle disc 61 consequently forms a flat disc with a circumferential guiding cover, wherein the disc is arranged between the planar end faces of the first and third vanes 601, 221 and can be rotated relative thereto. The rotation is preferably continuous. In other embodiments, it is stepped. In all cases, optical, haptic and/or acoustic means are preferably provided in order to indicate to the user that discrete positions of the throttle disc 61 have been reached. Furthermore, such means protect against unintentional adjustment.

The rotation of the throttle disc 61 serves to adjust the valve V. It is preferably carried out manually. Alternatively or additionally, however, it may also be carried out in a motor-operated manner.

The adjustment can preferably also be carried out with the valve V already mounted in the wall opening 10. This can be carried out in a simple embodiment by the flow element 3 and the lid 5 being removed. In a preferred embodiment which is illustrated in this instance by way of example, if at all, only the lid 5 is removed. The through-opening 33 in the cover 31 of the flow element 3 enables access to the adjustment element, in this instance the rotary pin 4. This can be clearly seen in FIGS. 1 to 4 and 7 and 8.

Figure 7:
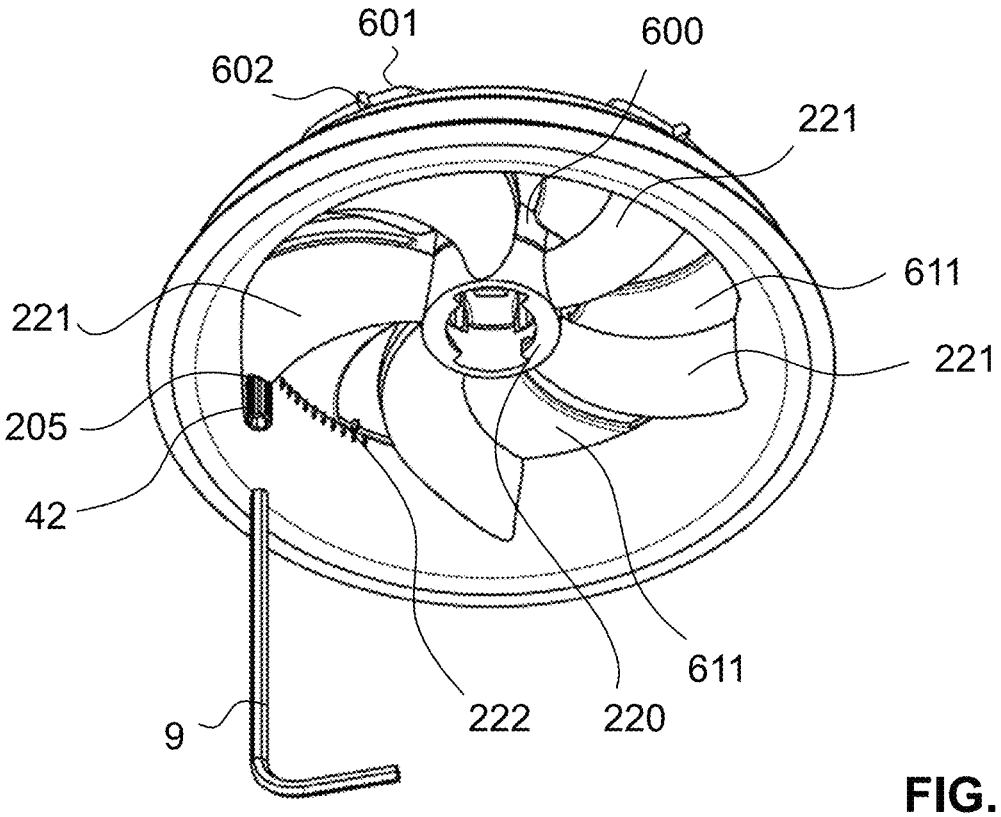
FIG. 7 shows a perspective view of the device without a flow element and lid according to FIG. 1 from below.
Figure 8:
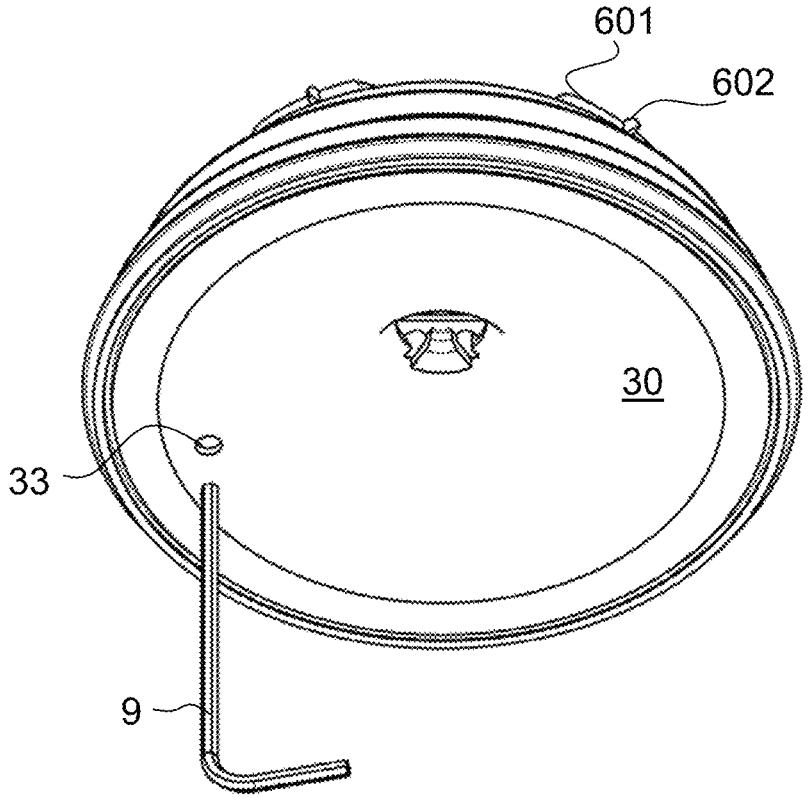
FIG. 8 shows a perspective view of the device without a lid according to FIG. 1 from below.

The rotary pin 4 has a pin 40, a head 41 which is in the form of a gear and a knurling 42 on the circumference of the free end of the pin 40. The knurling 42 increases the gripping ability when the rotary pin 4 is rotated by hand, without additional tools being used. As illustrated in FIGS. 7 and 8, however, there is preferably provided a tool 9 which can be plugged around or into the pin 40. Depending on the embodiment, the pin 40 is configured with an internal hexagon socket, a slot, a cross slot or a Torx in order to be able to be rotated with a correspondingly formed pin-like tool 9.

The rotary pin 4 extends through the recess 205 of the first housing portion 20, as can be seen in FIGS. 1 and 2. In this instance, the head 41 is positioned on the first housing portion 20.

The second throttle portion 61 has in a region of the inner circumference thereof a tooth arrangement 612. The gear of the head 41 engages as a result of the recess 205 in this tooth arrangement 612. By rotating the rotary pin 4, the second throttle portion 61 can be rotated about the longitudinal centre axis L. The position of the second vane 611 relative to the first and third vanes 601, 221 can consequently be manually adjusted.

Preferably, the first housing portion 20 has in addition to the recess a scale 222 which cooperates with a reference 614 of the second throttle portion 61. The setting of the throttle can thereby be noted and the rotary position of the vanes with respect to each other can be identified. This can be seen in FIGS. 2 and 3.

FIG. 7 shows how the tool 9 can be introduced into the rotary pin 4. A removal of the flow element 3 is generally not necessary for this purpose since, as can be seen in FIG. 8, the flow element 3 preferably has the through-opening 33 at an appropriate location.

Preferably, however, the flow element 3 can be removed and secured again in a simple manner. For example, as a result of a bayonet closure. In this instance, the rotary pin 4 can be exposed in a simple manner. The knurling 42 enables a rotation of the rotary pin 4 by hand, without tools.

The rotary pin enables as a result of a translation a very fine adjustment of the throttle 6, particularly when a tool is used for the rotation, but also in the case of a tool-free manual adjustment.

Preferably, there is provided a locking of the second throttle portion 61, that is to say, the throttle disc, and the rotary pin 4. The selected rotary position of the throttle disc is thereby permanently adjusted.

Other types of the adjustment of the various positions of the throttle disc 61 are possible.

As a result of the specific shape of the vanes of the throttle 6, it is ensured that in approximately every throttle position and over approximately every radius of the throttles 6, closed and open regions are present. An exception is at the most a maximum closed state of the throttle 6 and where applicable also a maximum open state of the throttle 6.

The term "maximum" does not mean in this context that all intermediate spaces between the first and third vanes 601, 221 are completely open or closed. They refer only to the two extreme positions which are possible for the respective throttle. Preferably, however, the end positions correspond to a complete closure and complete opening of the intermediate spaces between the first or third vanes 601, 221.

Figure 9:
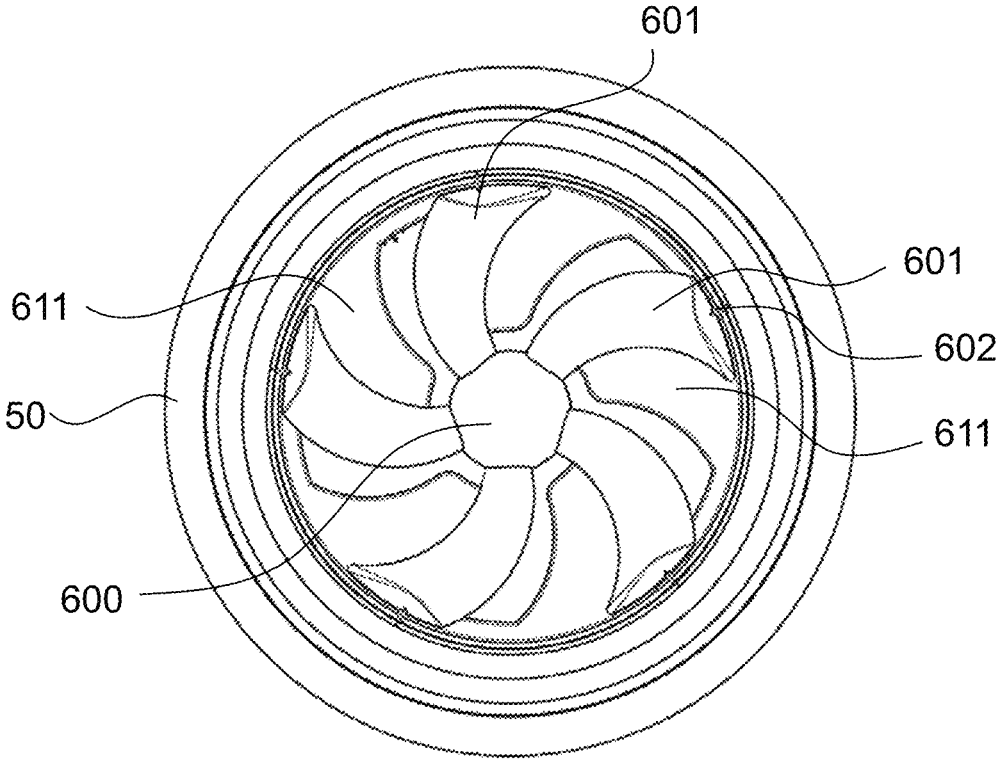
FIG. 9 shows a view of the device according to FIG. 1 from above in a partially closed position of the throttle.
Figure 10:
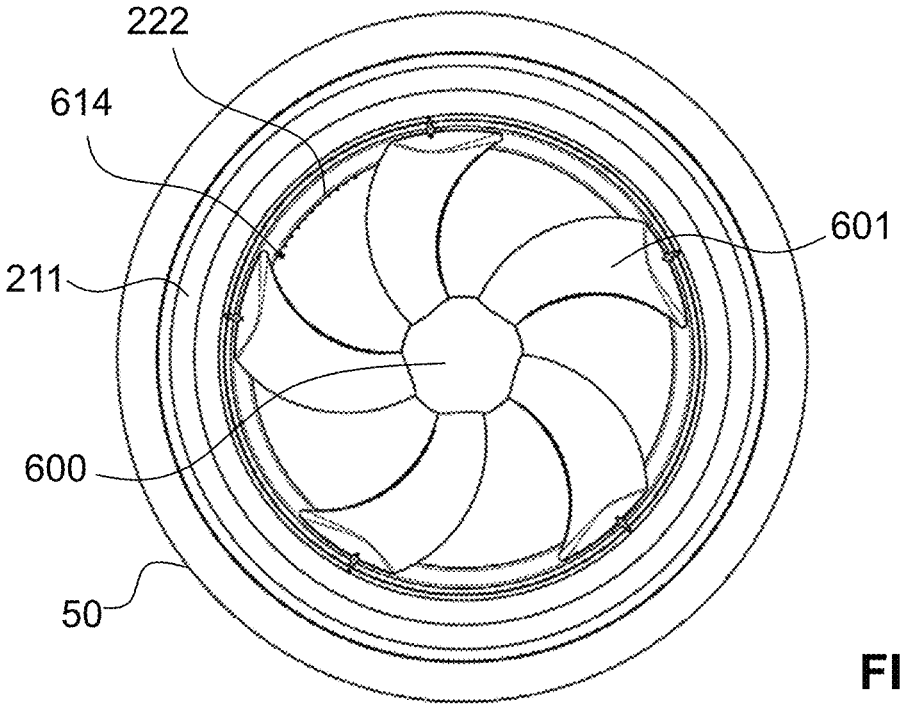
FIG. 10 shows a view of the device according to FIG. 9 from above in a completely open position of the throttle.

The cross sectional surface-areas of the second vanes 611 of the throttle disc 61 preferably correspond to the faces of the first and third vanes 601, 221. The through-openings of the throttle 6, formed by the respective spacings of the first or third vanes 601, 221, can be completely closed and completely opened. FIG. 9 illustrates a partially closed throttle 6 which can be closed even further. In FIG. 10, a completely open throttle 6 is illustrated.

The maximum end position in the closure direction is not illustrated. In this end position, the throttle 6 is completely closed.

The above-mentioned specific distribution of open and closed regions in the respective throttle settings is achieved by means of the bent shape of the individual vanes 601, 221, 611.

Figure 11:
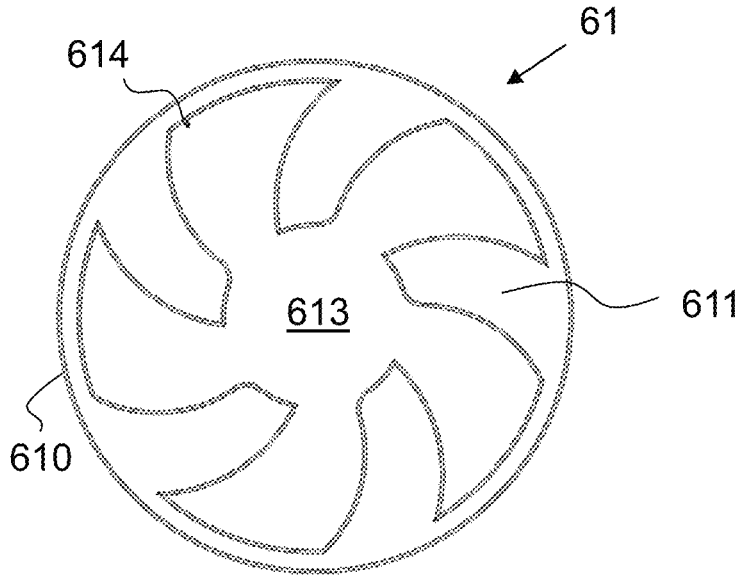
FIG. 11 shows a view of the second throttle portion from above.
Figure 12:
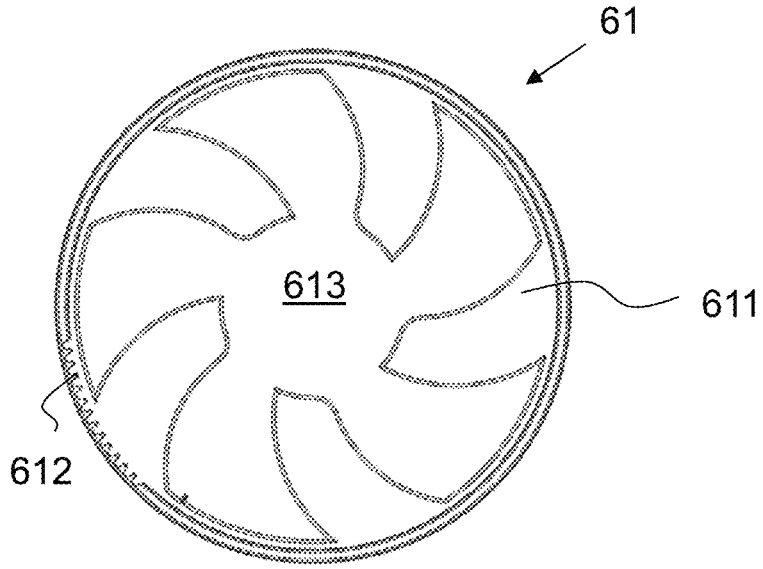
FIG. 12 shows a view of the second throttle portion from below.
Figure 13:
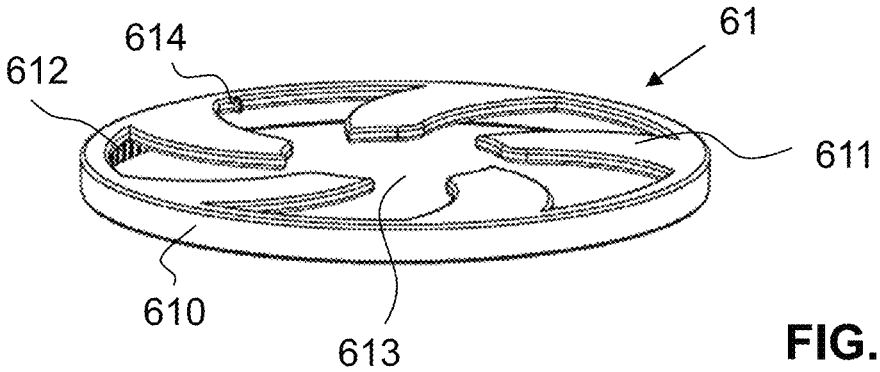
FIG. 13 shows a perspective view of the second throttle portion.

In addition, the second vanes 611 form a central through-opening 613 around the longitudinal centre axis L. This can be clearly seen in FIGS. 11 to 13. Hooks 603 extend through the central through-opening 613. However, it is configured to be larger than the cross section of the first and second coupling elements 600, 220. This leads to the region of the throttle 6 which can be flowed through expanding in the direction towards the longitudinal centre axis L.

The shape of the free ends of the second vanes 611 is preferably shaped in such a manner that it adapts to the shape of the first coupling element 600 of the first throttle portion 60 and completely closes the expanded region in the end position of the throttle.

As can be clearly seen in FIG. 9, the cross section of the partially open throttle 6 which can be flowed through forms mutually separate regions, wherein each of these regions has an L-shape. The long leg of the L-shape is bent in this instance. The short leg of the L-shape is preferably also bent slightly. Preferably, the transition from the long leg to the short leg is bent. It preferably forms an angle of more than 90°.

This L-shape is preferred, but not strictly necessary in order to implement the invention.

Figure 14:
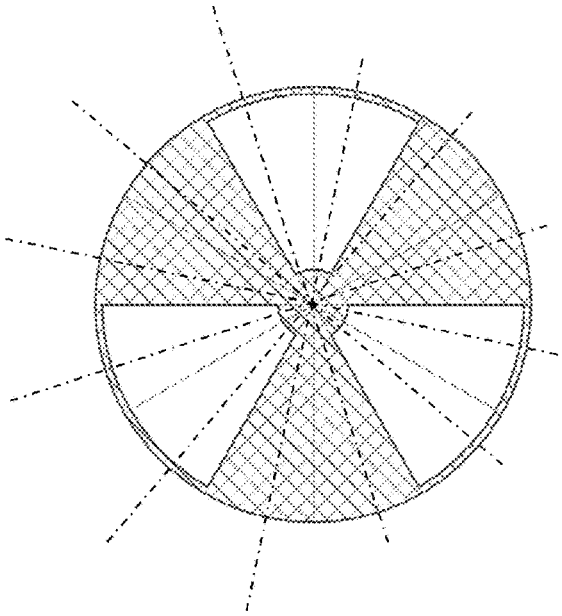
FIG. 14 shows a schematic illustration of a conventional throttle.
Figure 15:
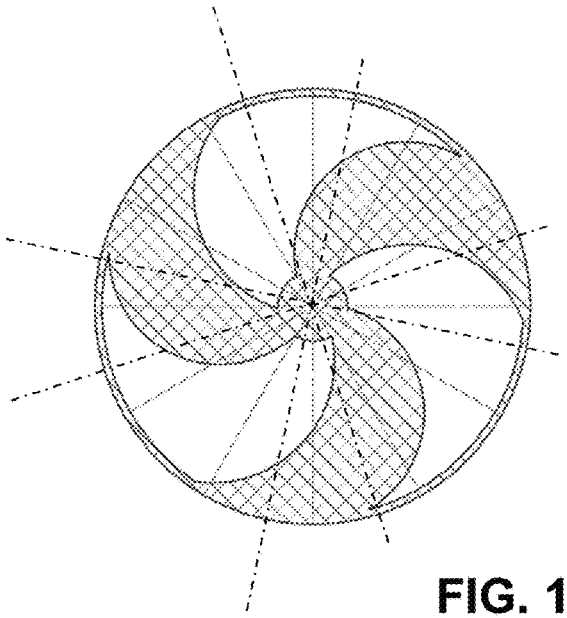
FIG. 15 shows a schematic illustration of a throttle according to the invention.
Figure 16:
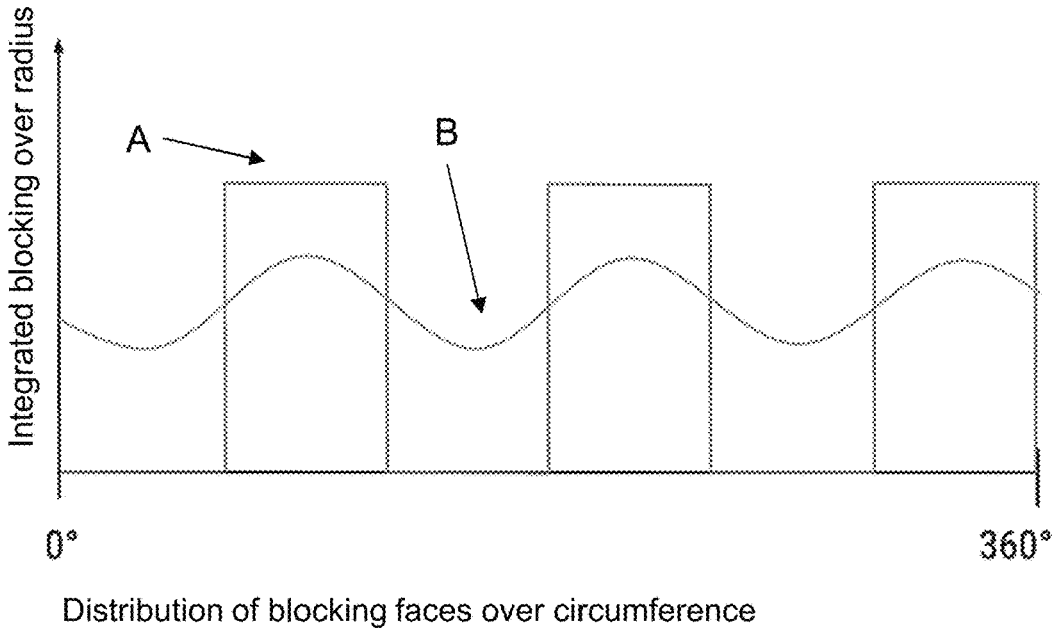
FIG. 16 shows a graphic illustration of the distribution of the blocking face over the circumferences and radii with the throttles according to FIGS. 14 and 15.

With reference to FIGS. 14 to 16, the difference of the construction of the vanes 601, 221, 611 of the throttle 6 according to the invention compared with known vanes can be illustrated.

FIG. 14 shows a known construction. The vanes are circle sectors. The crosses indicate the regions which can be flowed through when the throttle is completely open. The dashed lines show some radii. As can be easily seen, there are radii which are located completely in regions which are flowed through and radii which are located completely in closed regions.

FIG. 15 shows a throttle with bent vanes. Also in this instance, the crosses indicate the regions which are flowed through and the dashed lines indicate some radii. The bent vanes lead to all or approximately all radii extending both in regions which are flowed through and also in regions which are not flowed through, that is to say, which are closed.

As the graph according to FIG. 16 shows, for the throttle according to FIG. 15, the integrated blocking over the radius is more constant than for the throttles according to FIG. 14. This leads to a better flow distribution and prevents extremes in the flow speeds.

The device according to the invention for adjusting a volume flow optimizes the outflow behaviour and prevents divided flows.

The invention claimed is:

1. A device for adjusting an air volume flow, in particular in an air distribution network, wherein the device has an air channel which can be flowed through, wherein the air channel defines a longitudinal centre axis and radial directions, wherein the device has a throttle which is arranged in the air channel, wherein the throttle has at least a first throttle portion having first blocking elements and a second throttle portion having second blocking elements, wherein the position of the second blocking elements can be changed relative to the first blocking elements in order to change a size of a cross section, which can be flowed through, of the air channel, wherein in a first end position of the second blocking elements relative to the first blocking elements a minimum size of the cross section which can be flowed through is achieved and, in a second end position, a maximum size of the cross section which can be flowed through is achieved, wherein the first blocking elements and the second blocking elements are configured in such a manner that in approximately all positions between the first end position and the second end position in approximately any radial direction they form a portion of the cross section which can be flowed through, wherein the cross section which can be flowed through is expanded in at least some of the positions between the first and second end positions in the direction towards the longitudinal centre axis, wherein the first blocking elements terminate in a region of the longitudinal centre axis in a common central blocking centre portion, wherein the second blocking elements form free ends in a region of the longitudinal centre axis and wherein the free ends of the second blocking elements are arranged around a central free region which is greater in cross section than a cross section of the central blocking central portion, whereby a free annular region which is covered only partially by the first blocking elements is provided.

2. The device according to claim 1, wherein the cross section which can be flowed through in at least some of the positions between the first and second end positions is first tapered and is then expanded in the direction towards the longitudinal centre axis.

3. The device according to claim 1, wherein the cross section which can be flowed through forms in at least some of the positions between the first and second end positions a plurality of L-shaped regions which are subdivided by the first and second blocking elements.

4. The device according to claim 1, wherein all the positions, including the first and second end position, can be adjusted manually with the device mounted in a wall opening.

5. The device according to claim 1, wherein the first and second blocking elements are vanes which are configured to be curved in the radial directions.

6. The device according to claim 1, wherein the first blocking elements form bent inflow faces.

7. The device according to claim 1, wherein the second blocking elements are configured in a planar manner.

8. The device according to claim 1, wherein the device has a third throttle portion with third blocking elements which are arranged in a congruent manner with the first blocking elements, and wherein the second blocking elements are arranged between the first and third blocking elements and can be moved relative thereto.

9. The device according to claim 8, wherein the third blocking elements form bent outflow faces.

10. The device according to claim 1, wherein the first and, if provided, the third throttle portion is configured in a rotationally secure manner and the second throttle portion is configured to be able to be rotated about the longitudinal centre axis.

11. The device according to claim 1, wherein the device has a housing, which is configured for being received in a wall opening.

12. The device according to claim 1, wherein the device has an inner flow element, having a cover which is arranged spaced apart from the first and second throttle portions and, if provided, the third throttle portion, wherein the cover has a circumference which increases in the direction away from the throttle.

13. The device according to claim 11, wherein the housing is configured for clamping receiving in the wall opening.

14. The device according to claim 11, wherein the housing is configured for sealing receiving in the wall opening.

15. The device according to claim 11, wherein the housing is configured for clamping and sealing receiving in the wall opening.

* * * * *